US009677184B2

(12) United States Patent
Grant et al.

(10) Patent No.: US 9,677,184 B2
(45) **Date of Patent: *Jun. 13, 2017**

(54) MEASUREMENT OF ELECTRIC CURRENT IN AN INDIVIDUAL ELECTRODE IN AN ELECTROLYSIS SYSTEM

(71) Applicant: OUTOTEC (FINLAND) OY, Espoo (FI)

(72) Inventors: Duncan Grant, Bristol (GB); Michael H. Barker, Pori (FI); Lauri Nordlund, Espoo (FI); Ari Rantala, Porvoo (FI); Henri K. Virtanen, Pori (FI)

(73) Assignee: Outotec (Finland) Oy, Espoo (FI)

( * ) Notice: Subject to any disclaimer, the term of this patent is extended or adjusted under 35 U.S.C. 154(b) by 81 days.

This patent is subject to a terminal disclaimer.

(21) Appl. No.: 14/769,439

(22) PCT Filed: Feb. 27, 2014

(86) PCT No.: PCT/FI2014/050144

§ 371 (c)(1),
(2) Date: Aug. 20, 2015

(87) PCT Pub. No.: WO2014/131945

PCT Pub. Date: Sep. 4, 2014

(65) Prior Publication Data

US 2016/0002802 A1 Jan. 7, 2016

(30) Foreign Application Priority Data

Mar. 1, 2013 (FI) ..... 20135197

(51) Int. Cl.
*G01N 27/02* (2006.01)
*C25C 7/06* (2006.01)
(Continued)

(52) U.S. Cl.
CPC ..... *C25C 7/06* (2013.01); *C25C 1/12* (2013.01); *C25C 7/00* (2013.01)

(58) Field of Classification Search
USPC ..... 324/439, 444, 453, 463; 204/228.1, 204/229.8
See application file for complete search history.

(56) References Cited

U.S. PATENT DOCUMENTS 3,531,392 A 9/1970 Schmeiser
3,763,024 A 10/1973 Engelmann et al.
(Continued)

FOREIGN PATENT DOCUMENTS

JP 2-101185 A 4/1990
JP 11-323591 A 11/1999
(Continued)

OTHER PUBLICATIONS

PCT, International Search Report for International Application No. PCT/FI2014/050144, International Filing Date: Feb. 27, 2014 (Feb. 27, 2014), pp. 6.
(Continued)

*Primary Examiner* — Vincent Q Nguyen
(74) *Attorney, Agent, or Firm* — Chernoff Vilhauer LLP

(57) ABSTRACT

The invention relates to a method and current measuring arrangement for measuring electric current flowing in an individual electrode in an electrolysis system. The electrolysis system comprises a plurality of interleaved electrodes (1, 2), cathodes (1) and anodes (2), arranged in an electrolysis cell (3) and immersed in electrolyte, said electrolysis system having a busbar arrangement (4) disposed on a separating cell wall (5) between each of the two adjacent cells. The busbar arrangement comprises an equalizer busbar (6, 7, 8, 9, 10, 11) to electrically connect anodes in one cell to cathodes in a next cell providing the current with multiple
(Continued)

electrical pathways between electrodes, said electrical connection being formed by contact points (12) between the equalizer busbar (6, 7, 8, 9, 10, 11) and hanger bars (13) of the electrodes. The electric current in the equalizer busbar (6, 7, 8, 9, 10, 11) is measured by magnetic field sensing means (15, 16) arranged at measuring points (14) located between each pair of the adjacently neighboring contact points (12).

20 Claims, 7 Drawing Sheets

(51) Int. Cl.
*C25C 1/12* (2006.01)
*C25C 7/00* (2006.01)

(56) References Cited

U.S. PATENT DOCUMENTS 3,983,025 A 9/1976 Ralston, Jr.
6,136,177 A 10/2000 Hung
8,125,214 B1 2/2012 Steingart et al.
2003/0173227 A1 9/2003 Barnett et al.
2005/0053814 A1* 3/2005 Imamura ..... B60L 11/1881 429/413
2014/0209455 A1* 7/2014 Prado ..... C25C 7/00 204/229.8

FOREIGN PATENT DOCUMENTS

JP 3180902 7/2001
JP 2002-513859 A 5/2002
JP 2007-529629 A 10/2007
JP 2009156802 A 7/2016
WO 2009016190 A2 2/2009
WO 2012020243 A1 2/2012
WO 2013117805 8/2013

OTHER PUBLICATIONS

European Patent Office, Extended Search Report issued in application No. 14757730.8, Jul. I7, 2016, 6 pages, European Patent Office, Munich, Germany.
Notification of Reason for Refusal prepared by the Japanese Patent Office for JP 2015-559532; mailed Jan. 17, 2017, 5 pages.

* cited by examiner

MEASUREMENT OF ELECTRIC CURRENT IN AN INDIVIDUAL ELECTRODE IN AN ELECTROLYSIS SYSTEM

CROSS-REFERENCE TO RELATED APPLICATIONS

This is a national stage application filed under 35 USC 371 based on International Application No. PCT/FI2014/050144 filed Feb. 27, 2014 and claims priority under 35 USC 119 of Finnish Patent Application No. 20135197 filed Mar. 1, 2013.

STATEMENT REGARDING FEDERALLY SPONSORED RESEARCH OR DEVELOPMENT

Not Applicable.

THE NAMES OF THE PARTIES TO A JOINT RESEARCH AGREEMENT

Not Applicable.

INCORPORATION-BY-REFERENCE OF MATERIAL SUBMITTED ON A COMPACT DISC OR AS A TEXT FILE VIA THE OFFICE ELECTRONIC FILING SYSTEM (EFS-WEB)

Not Applicable.

STATEMENT REGARDING PRIOR DISCLOSURES BY THE INVENTOR OR A JOINT INVENTOR

Not Applicable.

FIELD OF THE INVENTION

The present invention relates to a method of measuring electric current flowing in an individual electrode in an electrolysis system. Further, the invention relates to a current measuring arrangement for measuring electric current flowing in an individual electrode in an electrolysis system.

BACKGROUND OF THE INVENTION

In electrorefining (ER) and electrowinning (EW) electrodes are immersed in an electrolyte and an electric current is passed between them. The anode is made positive and the cathode made negative so that an electric current passes through the electrolyte from anode to cathode.

In electrorefining (ER), the metal anode is soluble. That is to say that the metal enters into the electrolyte under the influence of the potential between the anode and cathode. For example, in the electrorefining of copper, the anode is made of impure metallic copper and copper ions enter the electrolyte from the anode. The copper ions, now in the electrolyte, are transported through or by the electrolyte to the cathode where they are deposited. The cathode may be of the same metal as the metal that is being deposited or it may be of a different metal. For example, in the electrorefining of copper it was at one time common to employ a cathode made of copper. However, a stainless steel permanent cathode is now commonly employed which quickly becomes coated with copper and which from then on essentially performs as a copper cathode. The deposited copper is mechanically removed or stripped from the permanent cathode and the permanent cathode reused. The copper deposited on the cathode is highly pure. Impurities that were in the impure anode may dissolve into the electrolyte or fall out as a solid as the anode is dissolved and may contain useful byproducts, for example, gold. Besides copper, metals purified by ER include gold, silver, lead, cobalt, nickel, tin and other metals.

Electrowinning (EW) differs from electrorefining in that the metal sought is imported into the cells and is already contained within the electrolyte. In the example of copper, sulphuric acid is typically employed to dissolve copper from an oxide form of copper ore and the resulting liquor, after concentration, is imported into an electrowinning cell to have the copper extracted. An anode and cathode are immersed in the electrolyte and a current is passed between them, again with the anode being positive and the cathode being negative. In electrowinning, the anode is not soluble but is made of an inert material. Typically a lead alloy anode is used in the case of copper electrowinning. The cathode may be of the same metal that is being extracted from the electrolyte or it may be of a different material. For example, in the case of copper, copper cathodes may be used although stainless steel cathodes are commonly employed which quickly become coated in copper. Under of the influence of an electric current, the metal to be won leaves the electrolyte solution and is deposited in a very pure form on the cathode. The electrolyte is circulated and concentrated by this process having given up a large proportion of its metal content. Besides copper, metals obtained by electrowinning include lead, gold, silver, zinc, chromium, cobalt, manganese, aluminium and other metals. For some metals, such as aluminium, the electrolyte is a molten material rather than an aqueous solution.

As an example of the voltages and current involved, in copper refining, the cell voltage is generally about 0.3V and in copper electrowinning is about 2.0V. In both cases the cathodic current density is about 300 $A/m^2$ and the area of each side of the electrode at present is about 1 $m^2$. These figures differ considerably for different metals and widely varying current densities may be used for the same metal but the invention applies to the electrorefining and electrowinning of all metals.

In ER and EW the starting point is an anode juxtaposed to a cathode in an electrolyte contained in a tank. But many cathode plates and many anode plates may be used, interleaved, with all the anode plates connected in parallel and all the cathode plates connected in parallel contained within a single tank of electrolyte. Electrically this still looks like a single cell and in the industry it is therefore commonly called a cell. In the ER and EW industry, "cell" is almost universally used to mean a tank filled with anodes and cathodes in parallel. In the ER and EW industry, "tank" can mean the same as "cell", above, or it can mean the vessel alone, depending on the context. In tankhouses cells are connected electrically in series. A typical ER tankhouse might therefore require an electrical supply of the order of 36,000 Amps at 200 Volts.

The electrical circuit representing a typical tankhouse is shown in FIG. 1. Tanks 3, each containing one cell (composed of many cathodes 1 in parallel and many anodes 2 in parallel), are connected in series. A DC voltage source 27 is connected across the series circuit to drive the desired current through the cells 3. The total current is maintained at a desired value. Ideally, the current should divide equally between the cathodes 1. In practice, there is significant variation in the resistance of each cathode-anode current path and hence there are variations in the values of the individual cathode currents. This means in practice that the metal production process operates at below optimum efficiency.

More seriously, there is sometimes disruption to the operation of part of the cell when a short circuit develops between an anode plate and a cathode plate. This is typically due to a nodule or dendrite of metal growing from a cathode plate and increasing in size until it connects with the adjacent anode plate. The nodule of metal has to be physically removed to permit normal operation to continue.

Another disruption to normal production can occur when an individual cathode or individual anode becomes disconnected from the electrical circuit. As FIG. 2 shows, the electrical connection to cathodes 1 and to anodes 2 is typically made through lugs or hanger bars 13 which project from each side of the electrodes. On the right side, the hanger bar 13 rests on a busbar arrangement 4 which forms part of the electrical circuit. The disconnection is typically caused by corrosion or burning of the contact point 12 or by a foreign obstacle becoming jammed between the hanger bar 13 and the busbar 4 or build-up of sulfate between the hanger bar 13 and the busbar 4. On the left side, the other hanger bar 13' may either rest on an insulated supporting bar 4' or this bar may be a secondary busbar, also known as an equaliser bar, so that the electrode 1 is electrically connected through two paths so as to reduce the effect of a bad contact to one of the hanger bars 13.

A short circuit results in an unusually large amount of current flowing in the cathode 1 and the anode 2 which are electrically shorted together. Methods conventionally employed to detect short circuits are less than ideal. One method is to detect the overheating of the electrodes resulting from the short circuit. This is less than satisfactory because damage to the electrode, its hanger bars 13 or the busbar 4 may have resuited due to a time delay before the short is detected.

This method will become even less acceptable as new, expensive, high-performance anodes, are introduced into electrowinning processes. In electrowinning, inert lead anodes have been commonly used. In recent years mixed metal oxide (MMO) catalytically coated titanium anodes have been increasingly adopted because of their superior properties. However, the MMO coated titanium anodes are more expensive than lead based anodes and more easily damaged by the heat generated during shorting. It has therefore become imperative that problems with the process, in particular short circuits between electrodes, are identified very quickly. Furthermore it is desirable that circumstances likely to give rise to a short circuit are identified. One indicator of an incipient short circuit is a rise in cathode or anode current above its usual value. Hence current measurement with an accuracy and resolution suitable for detecting this rise in current is a tool for identifying dangerous situations and for prompting operator action to correct the situation.

Another method of detecting shorts is to have a worker patrol the tanks using a Gaussmeter to detect the high magnetic field produced by the short-circuit current. Due to restricted labor the patrol can often be organized only once per day or a maximum of few times per day. Therefore the short may go undetected for many hours, during which time production is lost, current efficiency decreases, the risk of decreased cathode quality increases and the electrodes, hanger bars and busbars may be damaged. This method has also proved very inefficient because the patrol needs to check every cell including the cells that do not have any problems. Unnecessary walking on top the cells during the patrol may also cause electrode movement and thus new short circuits. It also increases the risk of accidents. Infrared cameras are also used either by the worker patrols or in overhead cranes to detect short circuits due to heat caused by high current. The method has often proved not to give the desired results in the tankhouse environment because of the long time delay in detecting a short and also availability issues of the crane for the monitoring task.

In order to detect short circuits and bad (open) contacts there is a need to detect these problems at the level of individual cathodes or anodes by providing methods for measuring the current flowing in individual electrodes.

In prior art, U.S. Pat. No. 7,445,696 discloses an electrolytic cell current monitoring device and method, which detects not only short circuits, but open circuits as well. The apparatus comprises magnetic field sensors, e.g. Hall effect sensors, that measure magnetic field strength generated around a conductor adapted to carry electrical current to or from an electrolytic cell. The magnetic field current sensors for each cathode may be arranged on a rail car device which operates above the cells to detect the shorts and open contacts. Detection of current in all cathodes in the cell can be made simultaneously. The magnetic field sensor is brought at a distance above each electrode hanger bar aided by a capacitive proximity sensor.

Further prior art is disclosed in an article "Measurement of Cathodic Currents in Equipotential Inter-Cell Bars for Copper Electrowinning and Electrorefining Plants". Industry Applications Conference, 2007. 42nd IAS Annual Meeting. Conference Record of the 2007 IEEE; 23-27 Sep. 2007; Wiechmann, E. P., Morales, A. S.; Aqueveque, P. E.; Burgos, R. P. pp. 2074-2079, proposes a measurement technique for the cathodic currents in a dog-bone type intercell bars using linear ratiometric Hall effect sensors and ferromagnetic flux concentrators. The article discloses that cathode currents may be measured by combining the magnetic flux sensors and flux concentrators.

Prior art solutions which are arranged to detect adverse conditions in the cells has focused on measuring the current flowing into or out of cathodes or anodes. The path which these currents take is through a hanger bar or lug, through a contact point between the hanger bar and busbar and then through a busbar. The path is one which changes direction or plane at least twice and after passing through the contact point its exact path is uncertain and variable. Hence the electrode currents are only realistically measurable in the hanger bars or at the contact point.

However, the measurement of the current in the hanger bars or at the contact point alone does not give the tankhouse operators sufficient information of the amount of current which actually flows in the electrode in the event there is a bad or open contact between the hanger bar of said electrode and the electric busbar due to that the equaliser busbar, which supports the other end of the electrode on the other side of the cell, is able to provide multiple pathways for the current so that current is conducted via the equaliser busbar from the adjacent other electrodes to the electrode which has the bad or open contact. Under ideal operating circumstances the equaliser bars connect points in the system which are at the same potential and the equaliser bar carries no current. When conditions are non-ideal, due to a variety of possible adverse circumstances such as said bad or open contacts, currents flow in the equaliser bars which tend to restore the system closer to its ideal operating condition. Currents flowing in the equaliser bars are therefore an indication that problems are arising with the process. Without the knowledge of the actual current flowing in the electrode it is not possible to detect or predict short circuits and open and bad contacts with a great certainty. Therefore, in order to obtain accurate current measurements for each individual electrode there is still a need for a measurement of the current which flows in the equaliser busbar between each contact point.

BRIEF SUMMARY OF THE INVENTION

The objective of the invention is to eliminate the disadvantages mentioned above.

In particular, it is an objective of the present invention to provide a method and a current measurement arrangement which enables an accurate measurement of the current in the equaliser busbar between each contact point.

Further, the objective of the invention is to provide method and arrangement for measuring the current entering or leaving the electrodes (cathodes and/or anodes) which will permit operators to detect early the presence of short circuits or open circuits.

Further, the objective of the invention is to provide method and arrangement, which enable, due to the sufficiently accurate current measurement, that the growth of the metal nodules or dendrites which lead to a short circuit may be detected before the short circuit occurs, allowing action to be taken to prevent a short occurring.

Further, the objective of the invention is to provide method and arrangement, which enable, due to the sufficiently accurate current measurement, that high resistance contacts (between the hanger bar contacts and their respective busbars) can be identified and early corrective action can be taken.

Further, the objective of the invention is to provide method and arrangement which enable, due to the sufficiently accurate current measurement, that the measurement can be of use for process control, either through real time adjustment of current flow or by improvements in plant operation resulting from analysis of the data.

Further, the objective of the invention is to provide method and arrangement, which, due to the sufficiently accurate current measurement, permits process analysis, and if required, dynamic process control, as well as the detection of incipient short circuits and actual short circuits and the detection of open circuits.

The Table 1 below shows the estimated current measurement accuracy required for the various objectives mentioned above. This invention aims to make current measurements of the highest accuracy thereby permitting process analysis, and if required, dynamic process control, as well as the detection of incipient short circuits and actual short circuits and the detection of open circuits.

The Table 1 below shows the estimated current measurement accuracy required for the various objectives mentioned above. This invention aims to make current measurements of the highest accuracy thereby permitting process analysis, and if required, dynamic process control, as well as the detection of incipient short circuits and actual short circuits and the detection of incipient open circuits as well as actual open circuits.

TABLE 1

| Objective | Accuracy Required |
|---|---|
| Process analysis and control | Between 1% and 5% |
| Detection of hanger bar contact deterioration | 10% or better |

TABLE 1-continued

| Objective | Accuracy Required |
|---|---|
| Detection of incipient short circuits | 25% or better |
| Detection of short circuits or open circuits | 50% or better |

According to a first aspect, the present invention provides a method of measuring electric current flowing in an individual electrode in an electrolysis system comprising a plurality of interleaved electrodes, cathodes and anodes, arranged in an electrolysis cell and immersed in electrolyte, said electrolysis system having a busbar arrangement disposed on a separating cell wall between each of the two adjacent cells, said busbar arrangement comprising an equaliser busbar to electrically connect anodes in one cell to cathodes in a next cell providing the current with multiple electrical pathways between electrodes, said electrical connection being formed by contact points between the equaliser busbar and hanger bars of the electrodes. According to the invention the electric current in the equaliser busbar is measured at measuring points located between each pair of the adjacently neighboring contact points.

According to a second aspect, the present invention provides a current measuring arrangement for measuring electric current flowing in an individual electrode in an electrolysis system comprising a plurality of interleaved electrodes, cathodes and anodes, arranged in an electrolysis cell and immersed in an electrolyte, said electrolysis system having a busbar arrangement disposed on a separating cell wall between each of the two adjacent cells, said busbar arrangement comprising an equaliser busbar to electrically connect anodes in one cell to cathodes in a next cell providing the current with multiple electrical pathways between electrodes, said electrical connection being formed by contact points between the equalizer busbar and hanger bars of the electrodes. According to the invention the current measuring arrangement comprises magnetic field sensing means for measuring the magnetic field induced by the electric current in the equaliser busbar, the magnetic field sensing means being arranged at measuring points located between each pair of the adjacently neighboring contact points.

The advantage of the invention is that the invention provides a method and arrangement for measuring the current entering or leaving the electrodes (cathodes and anodes) which will permit operators to detect the presence of short circuits or open circuits. Additionally, as the current measurement arrangement is of sufficient accuracy, the growth of the metal nodules or dendrites which lead to a short circuit can be detected before the short circuit occurs and corrective action taken to prevent a short occurring. Additionally, if the current measurement is of sufficient accuracy, high resistance contacts (between the hanger bars and their respective busbars) can be identified before they become open circuits and corrective action taken. Furthermore, if the current measurement can be made with even greater accuracy, the measurement can be of use for process control, either through real time adjustment of current flow or by improvements in plant operation resulting from analysis of the data. By use of a suitable algorithm and knowledge of the total current flowing through a cell, the currents flowing into or out of the cathodes and anodes can also be estimated. The invention is particularly applicable where a double-contact busbar arrangement is employed.

In an embodiment of the method, the electric current in the equaliser busbar is measured by sensing the magnetic field induced by said current flowing in the equaliser busbar.

In an embodiment of the method, the electric current in the equaliser busbar is measured by sensing magnetic field at the midpoint between each pair of the adjacently neighboring contact points.

In an embodiment of the method, the magnetic field of the electric current is sensed with a magnetic circuit being arranged to encircle the equaliser busbar.

In an embodiment of the method, the magnetic circuit is an open loop current sensor.

In an embodiment of the method, the magnetic circuit is a closed loop current sensor.

In an embodiment of the method, the magnetic circuit comprises a core of magnetic material formed as a ring surrounding the equaliser busbar.

In an embodiment of the method, the electric current in the equaliser busbar is measured at the measuring point by sensing the magnetic field with one or more Hall effect sensors arranged in proximity to the equaliser busbar.

In an embodiment of the method, the magnetic field induced by the current flowing in the equalizer busbar is sensed with an array of Hall effect sensors arranged in the vertical plane around the equalizer busbar at the measuring point.

In an embodiment of the method, the electric current in each electrode is measured by sensing the magnetic field induced by said current substantially at the level of the contact points to measure the current passing through the contact point.

In an embodiment of the method, the magnetic field at the contact point is sensed with a magnetic field sensor arranged in the vicinity of the contact point.

In an embodiment of the method, the magnetic field at the contact point is sensed with an array of magnetic field sensors arranged in three dimensional space around the contact point substantially in a plane of the contact point. The plane may be at an angle 0 to 75° in relation to horizontal.

In an embodiment of the method, a frame unit of insulating, non-magnetic material is arranged to hold the magnetic field sensors in a predetermined position with respect to equalizer busbar at measuring points and/or to hold the magnetic field sensors in a predetermined position with respect to the contact points.

In an embodiment of the arrangement, the magnetic field sensing means are arranged to sense the magnetic field at the midpoint between each pair of the adjacently neighboring contact points.

In an embodiment of the arrangement, the magnetic field sensing means comprise a magnetic circuit being arranged to encircle the equaliser busbar.

In an embodiment of the arrangement, the magnetic circuit is an open loop current sensor.

In an embodiment of the arrangement, the magnetic circuit is a closed loop current sensor.

In an embodiment of the arrangement, the magnetic circuit comprises a core of magnetic material formed as a ring surrounding the equaliser busbar.

In an embodiment of the arrangement, the magnetic field sensing means comprises one or more Hall effect sensors arranged in proximity to the equaliser busbar.

In an embodiment of the arrangement, the magnetic field sensing means comprises an array of Hall effect sensors arranged in the vertical plane around the equalizer busbar at the measuring point.

In an embodiment of the arrangement, the current measuring arrangement further comprises magnetic field sensing means arranged at the level of the contact points to measure the current passing through the contact point.

In an embodiment of the arrangement, the magnetic field sensing means comprises a magnetic field sensor arranged in the vicinity of the contact point.

In an embodiment of the arrangement, an array of magnetic field sensors arranged around the contact point substantially in the plane of the contact point.

In an embodiment of the arrangement, the array of magnetic field sensors is arranged in a three dimensional space around the contact point substantially in the plane of the contact point at an angle in the range 0 to 75° with respect to horizontal.

In an embodiment of the arrangement, the current measuring arrangement comprises a frame unit of insulating, non-magnetic material arranged to hold the magnetic field circuits and/or magnetic field sensors in a predetermined position with respect to the equalizer busbar.

In an embodiment of the arrangement, the frame unit is arranged to hold the magnetic field sensors in a predetermined position with respect to the to the contact points.

In an embodiment of the arrangement, the frame unit comprises a plurality of magnetic field sensors arranged to measure magnetic field from a plurality of measuring points along the equaliser busbar and/or from contact points.

In an embodiment of the arrangement, the frame unit comprises a plurality of magnetic field sensors arranged to measure magnetic field from a plurality of contact points.

In an embodiment of the arrangement, the frame unit comprises one or more notches, each of said notches being arranged to accommodate an end of an electrode hanger bar.

In an embodiment of the arrangement, the frame unit comprises one or more notches for one or more hanger bars of anodes.

In an embodiment of the arrangement, the frame unit comprises one or more notches for one or more hanger bars of cathodes.

In an embodiment of the arrangement, each notch is arranged to accommodate an end of a hanger bar with a play to allow installing of the frame unit by dropping it into position on the busbar without having to remove the electrodes and to allow lifting the electrodes without having to remove the frame.

In an embodiment of the arrangement, each notch is defined between two walls of the frame unit which are parallel and opposite and at a distance from each other, and that for measuring the current at the contact point, two magnetic field sensors spaced from each other are attached to each of the walls.

In an embodiment of the arrangement, the frame unit comprises notches for a number of hanger bars of cathodes and for a number of hanger bars of anodes.

In an embodiment of the arrangement, the arrangement comprises one frame unit extending substantially to the whole length of the cell.

In an embodiment of the arrangement, the arrangement comprises a plurality of frame units arranged in a row or queue on the busbar arrangement.

In an embodiment of the arrangement, the frame unit comprises a microprocessor for pre-analysis of the plurality of signals derived from the magnetic field sensing means.

In an embodiment of the arrangement, the microprocessors are arranged to connect and exchange information by digital, analog or wireless means.

In an embodiment of the arrangement, the frame unit comprises visual indicators which are arranged to indicate which electrodes have a problem associated with them which requires attention of the tankhouse operators.

In an embodiment of the arrangement, the visual indicators are controlled by the microprocessor which is arranged within the frame unit.

In an embodiment of the arrangement, the microprocessor is arranged to detect failure of a magnetic field sensor and to reorganise its analysis of the remaining magnetic field sensor signal so that the frame unit can continue to function.

In an embodiment of the arrangement, the microprocessor is arranged to provide a warning signal of the failure of a magnetic field sensor.

In an embodiment of the arrangement, the arrangement comprises a central processing unit arranged to receive signals from the microprocessors of the frame units.

In an embodiment of the arrangement, the microprocessors are arranged to connect and exchange information with the central processing unit by digital, analog or wireless means.

In an embodiment of the arrangement, the frame unit comprises temperature sensors arranged to measure the temperature of the electrode hanger bars.

In an embodiment of the arrangement, the frame unit comprises temperature sensors arranged to measure the temperature of the busbar arrangement.

In an embodiment of the arrangement, the frame unit is powered by an external unit or host.

In an embodiment of the arrangement, the frame unit comprises an electric energy storage device.

In an embodiment of the arrangement, the energy storage device is chargeable by energy harvesting from the ambient.

BRIEF DESCRIPTION OF THE SEVERAL VIEWS OF THE DRAWINGS

The accompanying drawings, which are included to provide a further understanding of the invention and constitute a part of this specification, illustrate embodiments of the invention and together with the description help to explain the principles of the invention. In the drawings.

DETAILED DESCRIPTION OF THE INVENTION

One embodiment of the invention relates to the use of Hall effect sensors to measure the magnetic field induces by the current flowing in the equaliser bar.

Figure 1:
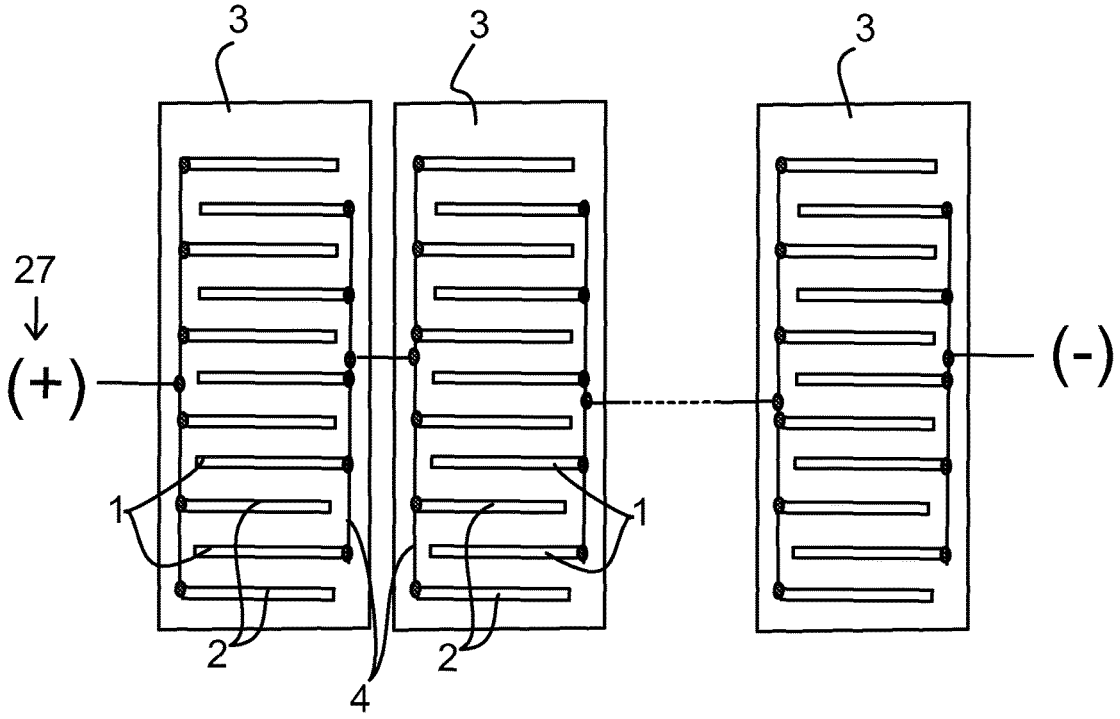
FIG. 1 is a schematic representation of the electrical circuit of a tankhouse.
Figure 2:
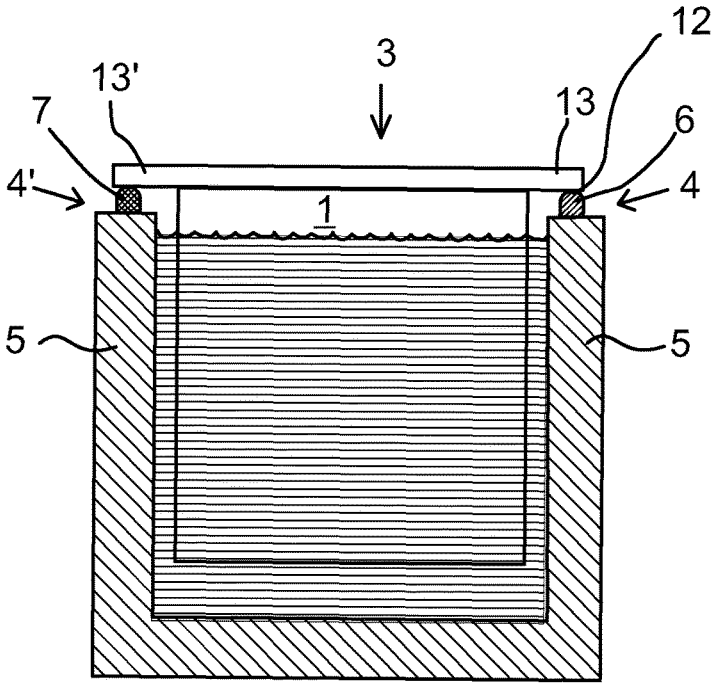
FIG. 2 is a cross-section of an electrolysis cell with an electrode immersed in electrolyte.
Figure 3:
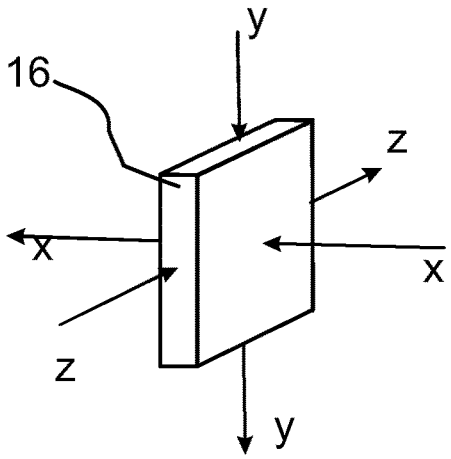
FIG. 3 is a schematic illustration of a Hall effect sensor.

FIG. 3 shows a typical Hall effect sensor 16. It is sensitive to magnetic flux passing through it in the x axis but not in the y or z axis. This can be used to discriminate between flux produced by current flowing in different planes.

Figure 4:
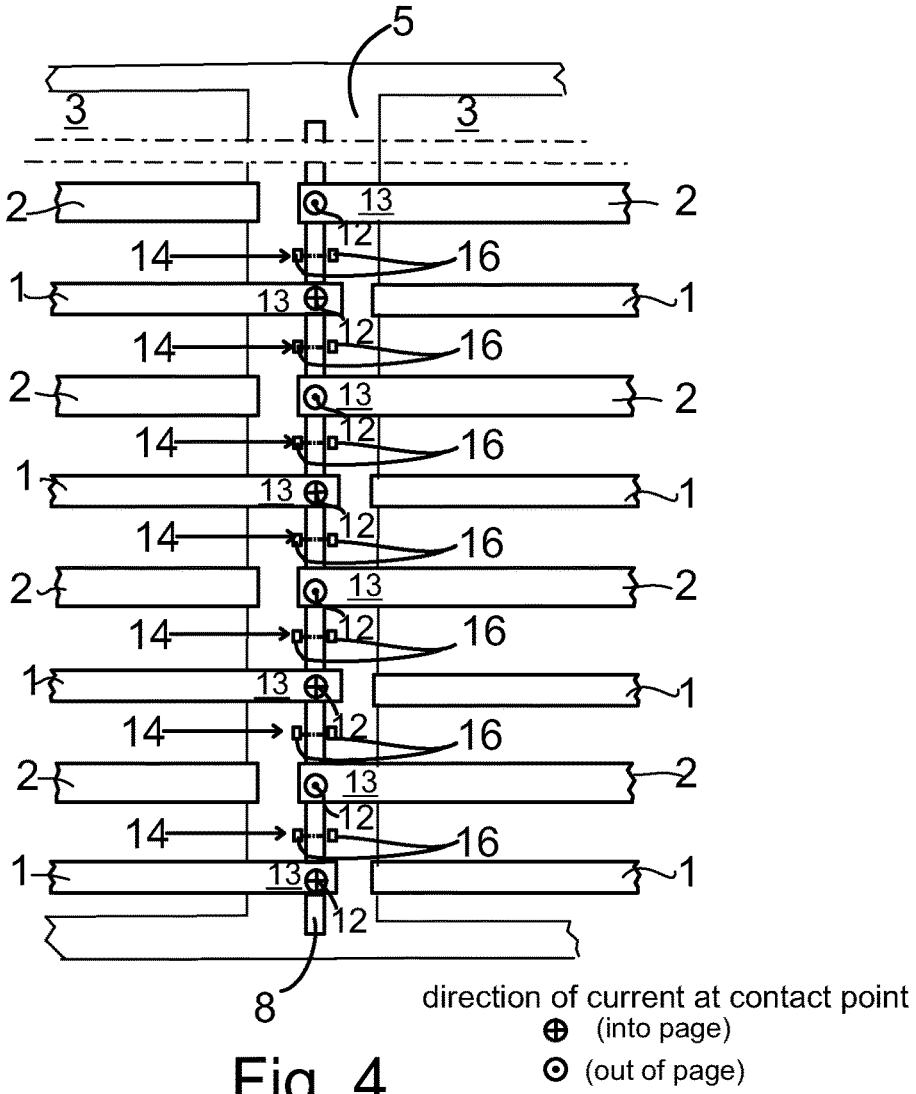
FIG. 4 shows a plan view a Walker busbar system between adjacent cells and equipped with a current measurement arrangement according to one embodiment of the invention.

FIG. 4 shows the current measure arrangement of one embodiment of the invention arranged in connection to the well-known Walker busbar system (Walker system is disclosed in U.S. Pat. No. 687,800). The electrolysis system comprises a plurality of interleaved cathodes 1 and anodes 2 arranged in an electrolysis cell 3 and immersed in an electrolyte. A Walker busbar arrangement 4 is disposed on a separating cell wall 5 between each of the two adjacent cells 3. The Walker busbar arrangement comprises one continuous busbar 8 extending along the whole length of the cell on top of the partition wall 5 between each of two adjacent cells 3 in order to electrically connect all of the anodes of the cell with all of the cathodes of the adjacent cell. As a result the cathodes 1 of one cell share the same electric potential with the anodes 2 of the next cell. The busbar 8 is therefore an equaliser busbar providing the current with multiple electrical pathways. The electrical connection between the electrodes 1, 2 and the busbar 8 is formed by contact points 12 between the busbar 8 and hanger bars 13 of the electrodes.

In the embodiment of FIG. 4 the current measuring arrangement comprises magnetic field sensing means, in this example Hall effect sensors 16, for measuring the magnetic field induced by the electric current in the equaliser busbar 8. The Hall effect sensors 16 are arranged at the measuring points 14, each of which is located between each pair of the adjacently neighboring contact points 12 of the hangers bars 13 of the anodes 2 and cathodes 1. More specifically, two Hall effect sensors 16 are deployed around each site of interest which is between the points at which the hanger bars 13 of the anode and cathode contact to the equaliser bar. Optionally, a single Hall sensor may be used at this location or any number of Hall sensors may be deployed at each such location. The signals from the Hall effect sensors (or Hall effect sensor) are used to determine the magnitude of current flowing in the equaliser bar at this location. Also, a measurement of these currents combined with a knowledge of the total cell current can be used to obtain an estimate of individual electrode (anode and cathode) currents.

FIGS. 5 to 9 show another way in which equaliser bars are commonly employed. Here the current measurement arrangement of the invention is adapted to be used in connection with the double-contact busbar system, trade name Outotec DoubleContact™, (also disclosed in U.S. Pat. No. 6,342,136 B1).

Figure 8:
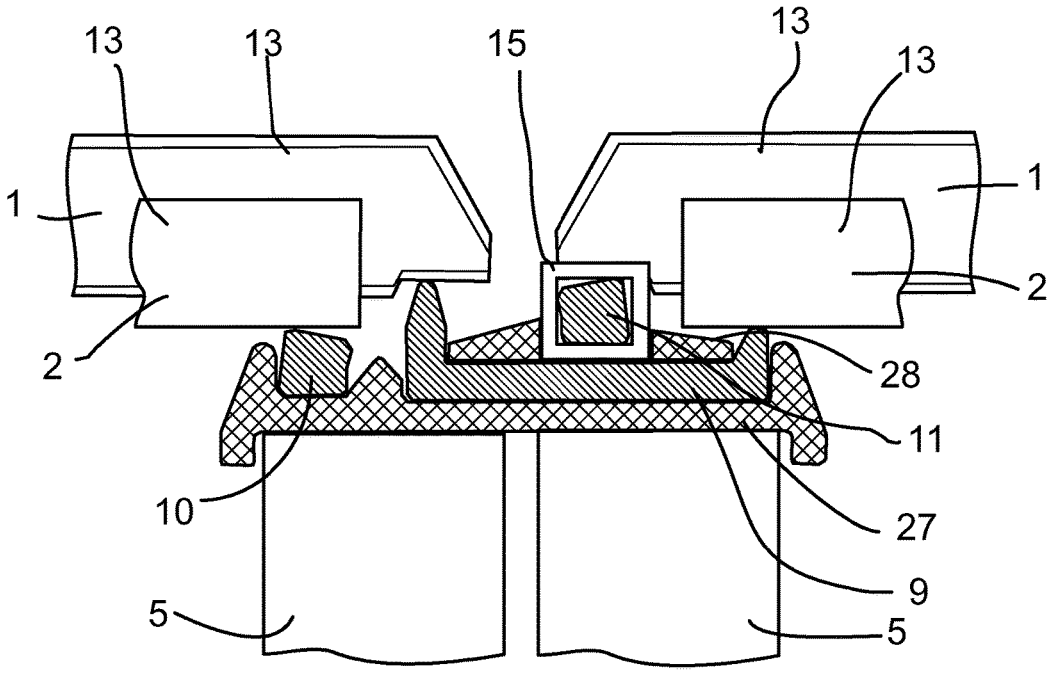
FIG. 8 shows a cross section of a double-contact busbar system with cathode and anode hanger bars having their contact points to the busbar conductors, and an open loop or closed magnetic field sensor deployed around an equaliser busbar for measuring the magnetic field induced by the electric current in the equaliser busbar.
Figure 9:
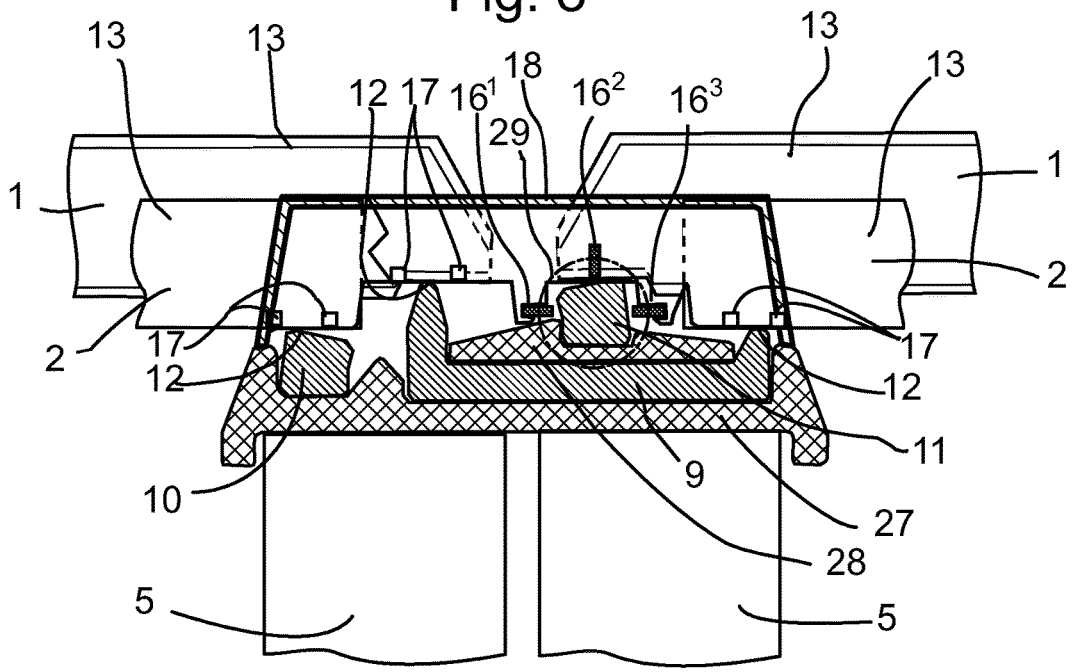
FIG. 9 shows a cross-section IX-IX of FIG. 7, illustrating a double-contact busbar system with cathode and anode hanger bars having their contact points to the busbar conductors, and an array of Hall effect sensors deployed around an equaliser busbar for measuring the magnetic field induced by the electric current in the equaliser busbar, and the frame unit also being equipped with Hall effect sensors to detect the current passing through the contact points.

A cross-section of the double-contact busbar arrangement is shown in FIGS. 8 and 9.

Referring to FIGS. 5 to 9, the double-contact busbar system comprises a main intercell busbar 9, placed on a lower insulator 27, to conduct current from anodes 2 to cathodes 1. Further the system comprises a first equaliser busbar 10, placed on the lower insulator 27, for anode contacts and a second equaliser busbar 11 for cathode contacts, said second equaliser busbar 11 being placed on a second insulator 28 which is on the main intercell busbar 4. The double-contact busbar system aids the current distribution in the cell to be even across all electrodes. This system also provides the current with multiple paths to find the lowest resistance route between anode and cathode as the current goes from the busbar to the electroplating process.

Figure 5:
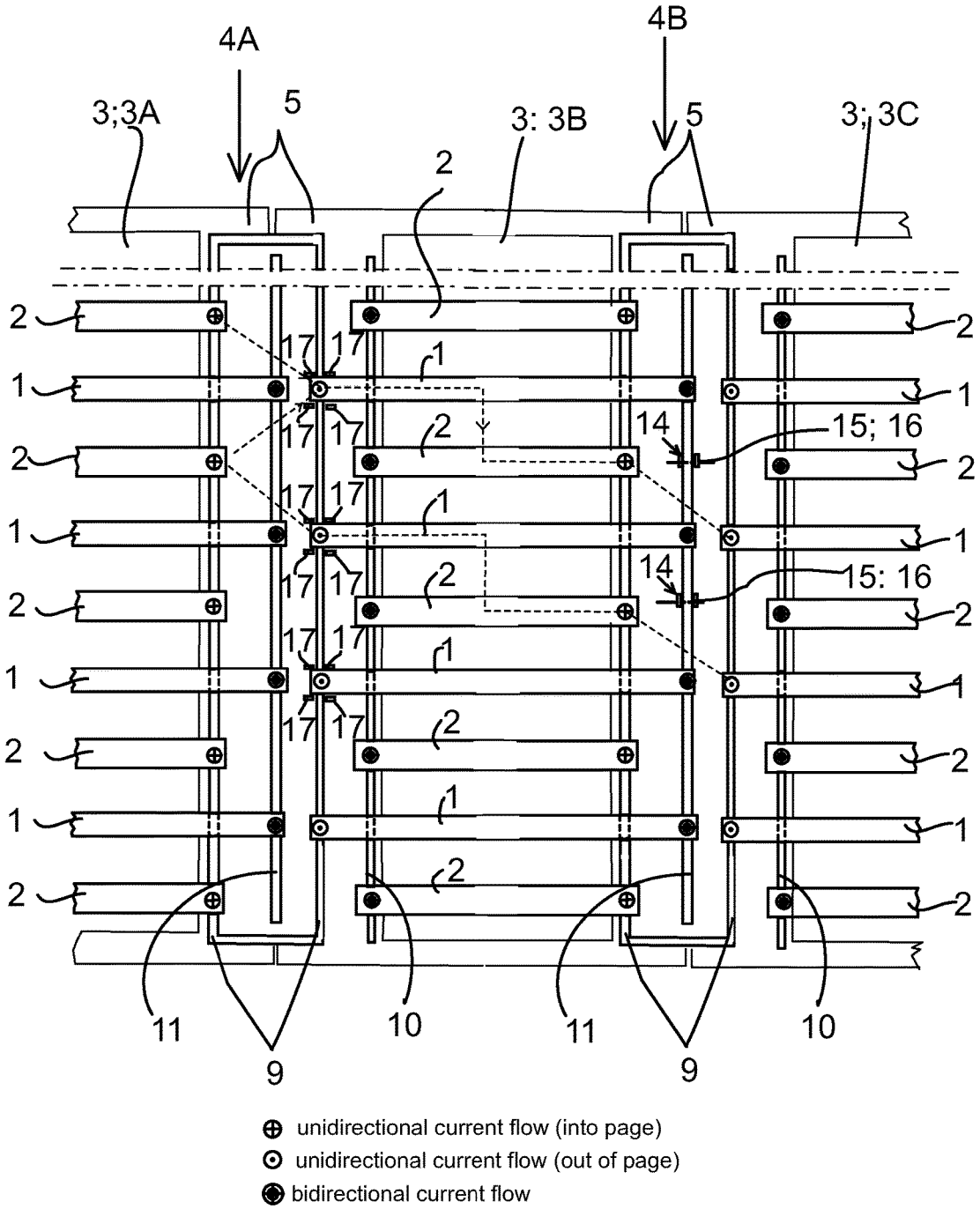
FIG. 5 shows in plan view a part of an electrolysis system with a double-contact busbar arrangements having a main busbar and two equaliser bars between adjacent cells, FIG. 5 illustrating the current flow in an ideal condition.
Figure 6:
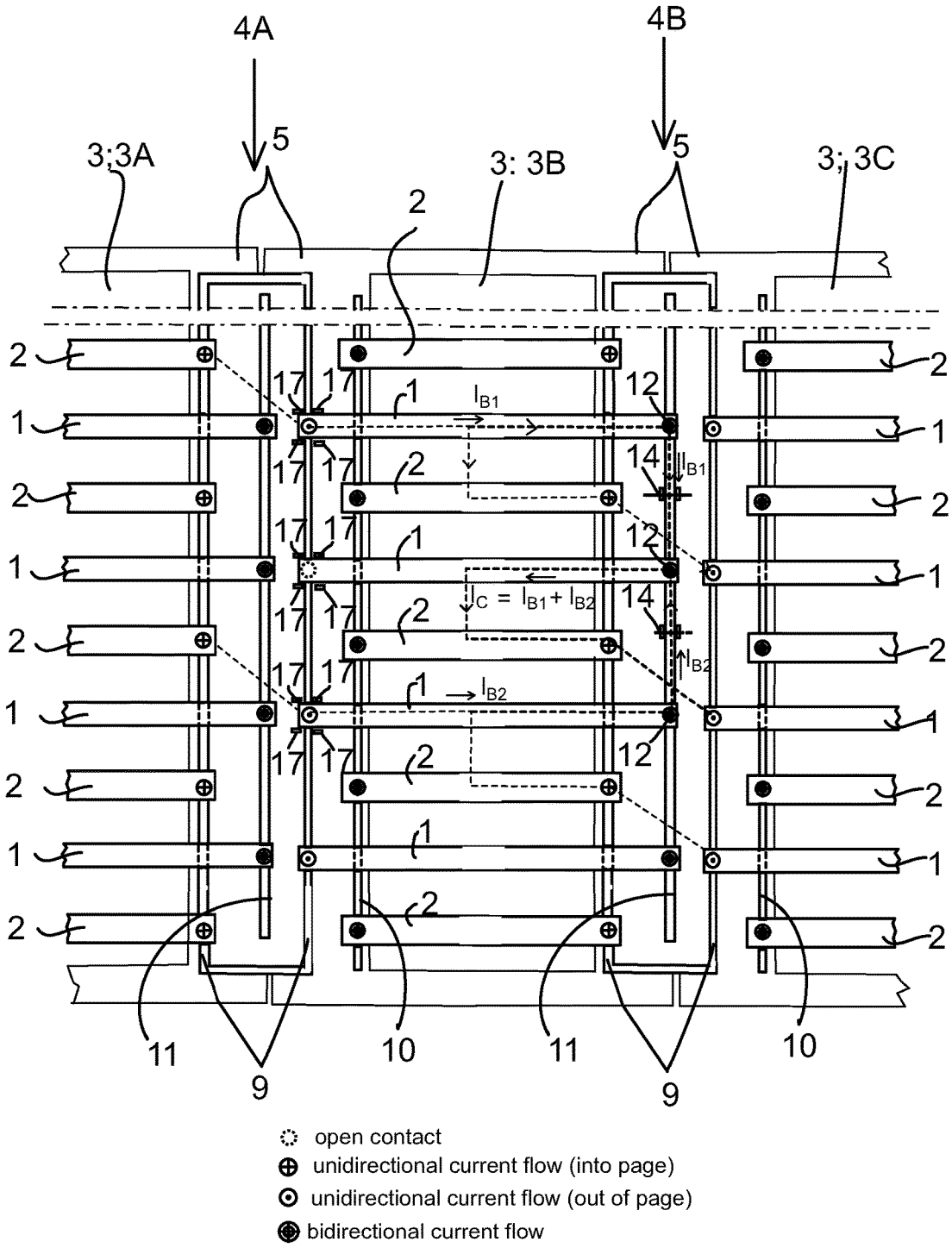
FIG. 6 shows in plan view of FIG. 5 in a non-ideal condition herein there is an open contact between one cathode hanger bar and the main busbar and showing the current flows from adjacent cathodes via the equaliser bar on the other side of the cell and also showing the current sensors to measure the currents.

Referring to FIGS. 5 and 6, in the double-contact busbar arrangement 4A on the left side, located between the cells 3A and 3B, the current incoming from anodes 2 (e.g. which belong to cell 3A) is conveyed to cathodes 1 (e.g. which belong to cell 3B) via the main intercell busbar 9 which can be called also as a main equaliser busbar. The first equaliser busbar 10 electrically connects together the left side ends of the hanger bars of anodes 2 which belong to cell 3B. The second equaliser busbar 11 electrically connects together the right side ends of the hanger bars of cathodes 2 which belong to cell 3A.

In the double-contact busbar arrangement 4B the on the right side (which is identical to busbar arrangement 4A), located between the cells 3B and 3A, the current incoming from anodes 2 (e.g. which belong to cell 3B) is conveyed to cathodes 1 (e.g. which belong to cell 3C) via the main intercell busbar 9 which can be called also as a main equaliser busbar. The first equaliser busbar 10 electrically connects together the left side ends of the hanger bars of anodes 2 which belong to cell 3C. The second equaliser busbar 11 electrically connects together the right side ends of the hanger bars of cathodes 2 which belong to cell 3B.

In ideal operation, as shown in FIG. 5, all the hanger bars of the cathodes 1 would be at the same potential and no current would flow along the second equaliser busbar 11 of the busbar arrangement 4B. The second equaliser busbar 11 is floating electrically and therefore the algebraic sum of the currents entering this equaliser busbar 11 must be zero. The object of the second equaliser busbar 11 is to electrically interconnect the normally un-used hanger bars of the cathodes 1 which in an ideal situation would be at the same potential.

In FIG. 6 a non-ideal condition is shown, wherein an open contact occurs between one cathode 1 belonging to the cell 3B and the main equaliser busbar 9 in the busbar arrangement 4A. Due to lack of electrical contact no current flows from the main equaliser busbar 9 to said cathode 1. Then current is redistributed between adjacent cathodes 1 by currents $I_{B1}$ and $I_{B2}$ which flow in the equaliser busbar 11 (see the busbar arrangement 4B) between the contact points 12 of the adjacent cathodes to the equaliser busbar 11 and enters said cathode 1 which suffers lack of normal electrical hanger bar contact. Under such non-ideal conditions, which the present invention aims to detect and measure, current will flow along the equaliser bar 11 between cathode 1 hanger bars in one direction or the other. The cathode 1 which lacks an electrical contact to the main equaliser busbar 9 in the busbar arrangement 4A receives current from the adjacent cathodes 1 through the second equaliser bar 11 which belongs to the busbar arrangement 4B on the right side. By measuring the currents $I_{B1}$ and $I_{B2}$ flowing in the equaliser busbar 11 of the busbar arrangement 4B at the measuring points 14 located between each pair of the adjacently neighboring contact points 12 of the cathodes 1, it is possible to determine the actual current $I_C$ which is an algebraic sum of the measured currents $I_{B1}$ and $I_{B2}$. This current measurement result enables early detecting an incipient short circuit and nodule or dendrite developing also in that case wherein the current cannot be measured at the contact point due to the open contact.

Figure 7:
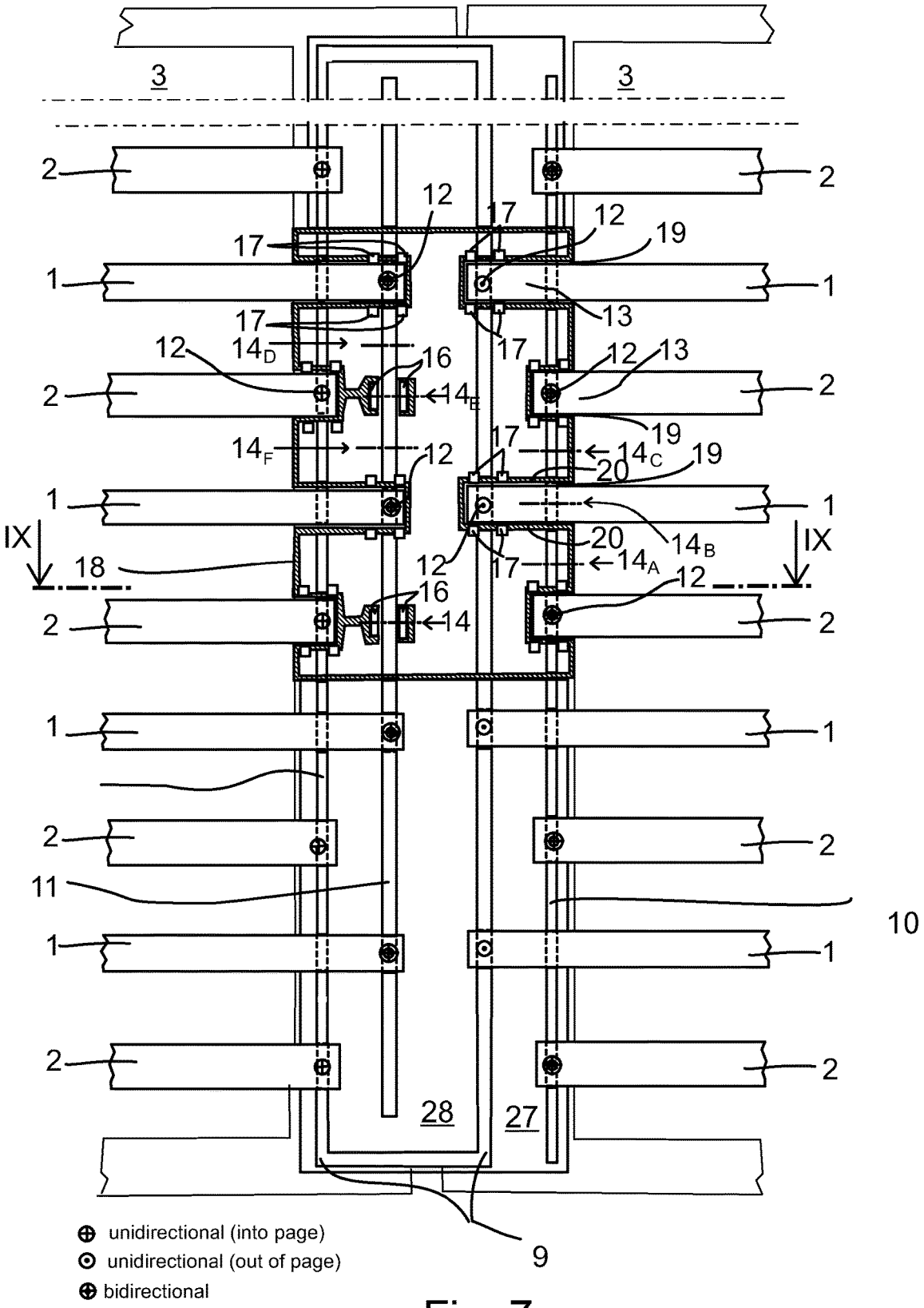
FIG. 7 shows in plan view the double-contact busbar system wherein the frame unit covers four cathodes and anodes the frame unit being equipped with magnetic field sensing means for measuring the magnetic field induced by the electric current in the equaliser busbar and also magnetic field sensing means around each contact point for measuring the magnetic field induced by the electric current passing through the contact points.

Reference is made to the FIG. 7 which shows a double-contact busbar arrangement as already disclosed with reference to FIGS. 5 and 6. The FIG. 7 shows different locations for the measuring points 14. Site 14A, site 14B and site 14C indicate three locations (repeated along the equaliser bar) where this current flow may be measured using one or more Hall effect sensors 16 (see also FIG. 9) or an open loop or closed loop current sensor 15 (see also FIG. 8). For site 14B there are some space limitations because of the presence of a hanger bar of the cathode 1 above the site as well as the current flowing in the hanger bar of the cathode which could make accurate current measurement difficult. Sites 14A and 14C are more free of obstruction and further away from currents which could interfere with the measurement. Sites 14A and 14C (or all three sites) could be used cooperatively so that, for instance, sites 14A and 14C could cooperate to give a larger signal than each site would provide individually as well as offering better rejection of unwanted current signals.

Again referring to FIG. 6, it will be seen that a first equaliser bar 10 is used to electrically connect the hanger bars of anodes 2. Its purpose is similar to that of the second equaliser bar 11—that is, to redistribute current between anodes 2 when some non-ideal condition in cell 3B would otherwise produce a significant inequality of current in anodes of cell 3B. Hence current flowing in the floating equaliser bar 10 indicates a non-ideal situation in cell 3B which can be measured and assessed by measuring said current flows in the equaliser bar 10.

Further referring to the FIGS. 5 to 7, as already mentioned, the current measuring arrangement may further comprise magnetic field sensing means 17 arranged at the level of the contact points 12 substantially in the horizontal plane of the contact point 12 to measure the current passing through the contact point. The magnetic field sensors 17 may be e.g. one or more Hall effect sensors or an open or closed loop magnetic circuit with a Hall effect sensor. FIGS. 5 to 7 shows an array of magnetic field sensors 17 (in this example four) arranged around the contact points 12 substantially in the horizontal plane of the contact point.

Referring again to FIG. 7, it shows possible sites 14E (at the midpoint between the contact points) and 14D and 14F (both offset from the midpoint) of the measuring points (repeated along the equaliser bar 11) all being suitable locations for sensing the current flow in the equaliser bar 11. The current at each site may be sensed by one or more Hall effect sensors or an open loop or closed loop current sensor.

Again, the measuring point sites may cooperate to obtain a stronger signal with less interference form currents in adjacent conductors.

FIGS. 7 and 9 show a frame unit 18 of insulating, non-magnetic material. The frame unit 18 holds the magnetic field sensing means in a predetermined position with respect to the equaliser busbar 11, the magnetic field sensing means consisting of an array of Hall effect sensors 16 shown in FIG. 9 to encircle the equaliser busbar in a vertical plane and arranged in the midpoint between adjacent contact points 12. The frame unit 18 also holds the magnetic field sensors 17 in a predetermined position with respect to the contact points 12. The frame unit 18 comprises a plurality of magnetic field sensors 16 arranged to measure magnetic field from a plurality of measuring points 14 along the equaliser busbar 11. The frame unit 18 also comprises a plurality of magnetic field sensors 17 arranged to measure magnetic field from a plurality of contact points 12. The frame unit 18 comprises a plurality of notches 19, each of which is arranged to accommodate one end of an electrode hanger bar 13 with a play to allow installing of the frame unit(s) by dropping it into position on the busbar without having to remove the electrodes and to allow lifting the electrodes without having to remove the frame unit(s). In this embodiment the frame unit 18 comprises notches 19 for four ends of hanger bars 13 of cathodes 1 and for four ends of hanger bars 13 of anodes 2. Each notch 19 is defined between two walls 20 which are parallel and opposite and at a distance from each other. A pair of magnetic field sensors 17, e.g. Hall effect sensors, which are spaced from each other, are attached to each of the walls 20.

Figure 10:
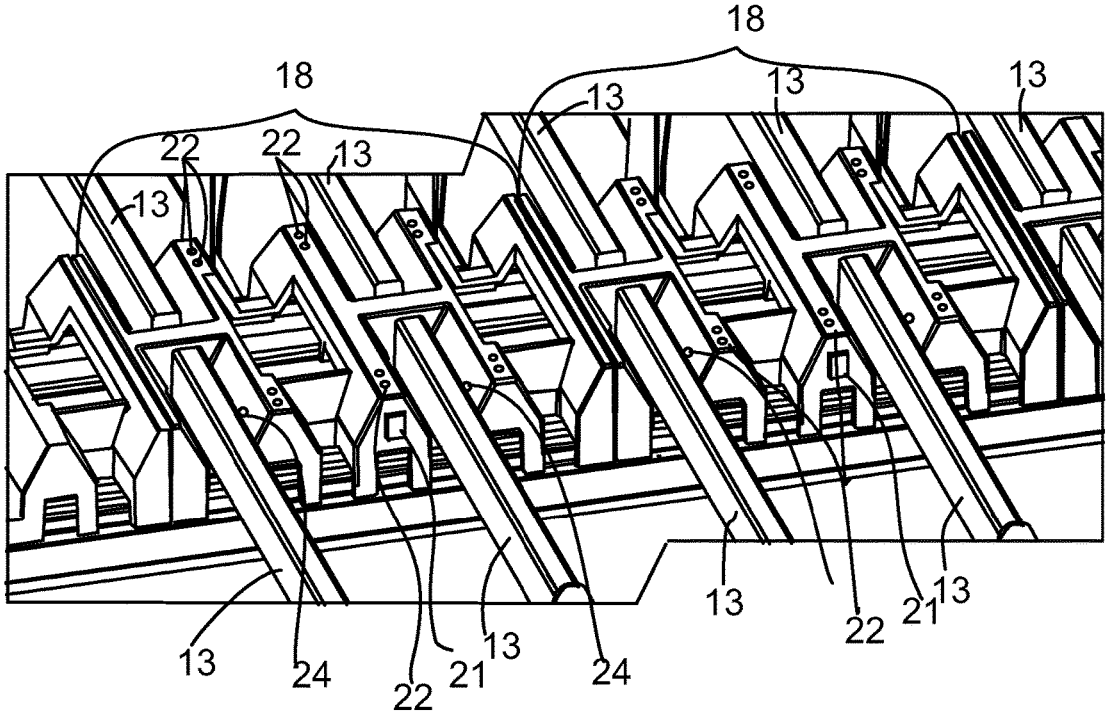
FIG. 10 shows in axonometric view an embodiment of the frame units which are designed so as to be able to be dropped onto a set of ends of cathode and anode hanger bars while the ER or EW system is in operation and which allows unhindered lifting of anodes and cathodes.

A plurality of frame units 18 may be arranged in a row or queue on the busbar arrangement, as shown in FIG. 10. It is also possible to form the frame unit 18 so that it extends substantially to the whole length of the cell 3.

In the embodiment of FIGS. 5 to 7 the current passing through the contact points 12 of both cathodes 1 and anodes 2 are monitored, though it is a matter of choice whether cathodes or anodes or both are monitored. The more contact points 12 that are monitored, the better will be the ability of the system to suppress inaccuracy in any particular current measurement due to the presence of currents in adjacent conductors.

The frame unit 18, as shown in FIGS. 7, 9 and 10, permits the anodes 2 and cathodes 1 to be lifted from the cell 3 without hindrance. Appropriate design of the frame unit 18 also allows the frame unit to be dropped into position on a working ER or EW system without interfering with production. Clearly this is an advantage where the current measuring system is retrofitted to an existing ER or EW plant. The frame units 18 may be constructed so heavy that they stay stationary on the busbar and are not lifted during harvesting even if the hanger bars frictionally contact the frame unit. In addition, or alternatively, the frame units 18 can be equipped with quick release couplings to fix them to the cell wall or to the busbar.

FIG. 8 shows an embodiment wherein the magnetic field sensing means for measuring the current flowing in the equaliser busbar 11 is a magnetic circuit 15 comprising a core of magnetic material formed as a ring surrounding the equaliser busbar 11.

FIG. 9 shows an embodiment wherein the magnetic field sensing means for measuring the current flowing in the equaliser busbar 11 is an array of Hall effect sensors shown grouped around equaliser bar 11 by way of illustration. The sensors are oriented in such a way as to maximise their exposure to the wanted magnetic flux 29 (deriving from the current in the equaliser bar 11). Either sensor $\mathbf{16}^1$ or $\mathbf{16}^3$ could be used alone or together and in cooperation with each other.

Used in cooperation, the sum of the signal from these two sensors would have reduced sensitivity to their accidental displacement from their ideal position about the equaliser bar 11. This is a useful attribute when the sensors are not firmly attached to the equaliser bar support structure but rather are carried on a frame unit 18 which is separate from the busbar structure and which can be placed on top of the busbar structure subsequent to the building of the bus bar structure of when the frame units are fitted to an existing plant in a retrofit exercise.

Sensor $\mathbf{16}^2$ may have better rejection of flux generated by currents that flow orthogonally to the current in the equaliser bar 11. Sensor $\mathbf{16}^2$ could be used alone or in cooperation with sensors $\mathbf{16}^1$ and $\mathbf{16}^3$.

FIG. 10 shows a row or queue of equal frame units 18, as described in connection with FIG. 7, placed on the intercell busbar. In FIG. 10 only hanger bars 13 of cathodes 1 resting on the busbar are shown and hanger bars of the anodes are not shown. The frame units 18 are so designed that they may be dropped into position without interfering with production. Also they are so designed that the raising of cathodes and anodes is unhindered by the presence of the frame units 18. The frame unit 18 can comprise visual indicators 22 which are arranged to indicate which electrodes have a problem associated with them which requires attention. Where the frame unit 18 is endowed with visual indicators 22 (e.g. LEDs on its upper surface) it will be understood that these visual indicators 22 can provide information in ways other than being simply on or off. For example they may flash, at various rates, or change colour or employ a range of LEDs of various colours. Furthermore, a visual indicator 22 may be an infra-red light emitter so that information may be conveyed to a hand-held operator instrument or to a fixed infrared receiver. Visual indicators 22 may be LEDs located on the top of each frame unit 11 and can be used as a visual indicator of the position of anodes or cathodes that are in distress and need attention from an operator. The data transmitted back to the control room can also show an operator which anodes or cathodes need to be serviced.

Figure 11:
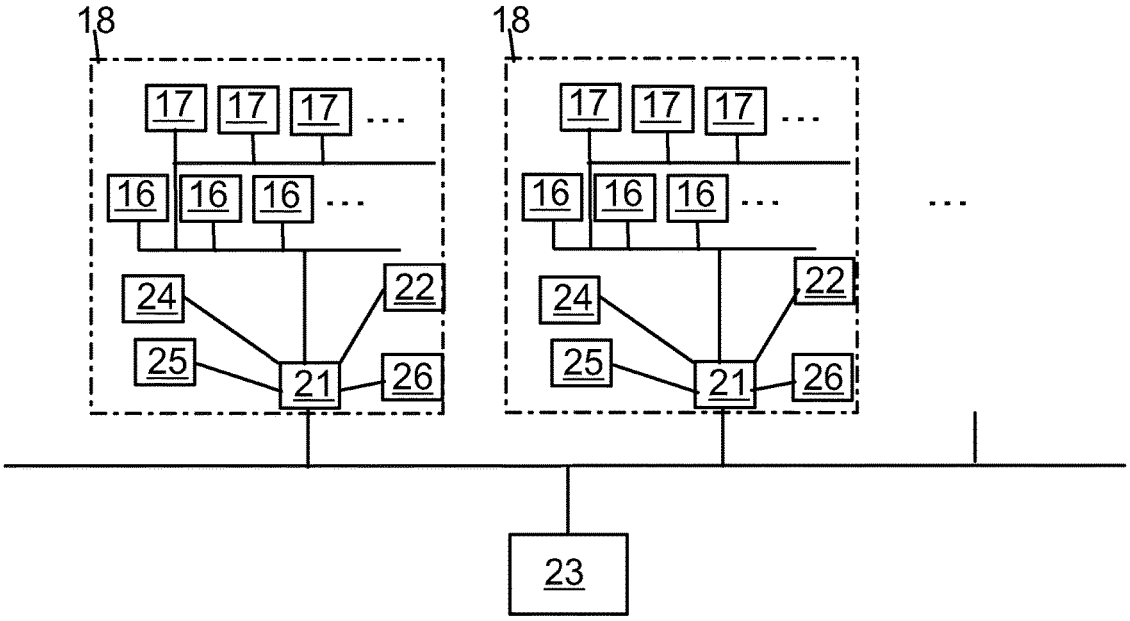
FIG. 11 is a block diagram of one embodiment of the arrangement of the invention.

Referring also to FIG. 11, the frame unit 18 may also comprise a microprocessor 21 for pre-analysis of the plurality of signals derived from the magnetic field sensors 16, 17 so that only derived current measurement signals need to be transmitted to a central processing station 23. In some other embodiment, the microprocessor does not necessarily be physically fixed to the frame unit. The microprocessor can also be external and outside the frame unit. The microprocessor 21 may also be programmed to contain individual ID and location information. The visual indicators 22 are controlled by the microprocessor 21. The microprocessor 21 within each frame unit 18 is given the capability to detect failure of a Hall effect sensor 16, and to reorganize its analysis of the remaining Hall sensor signal so that the frame unit 18 can continue to function, albeit in a slightly degraded manner, and at the same time, where possible, provide a warning signal to the central control room of the failure and degradation so that the frame unit may be replaced during a period of scheduled maintenance. The arrangement comprises a central processing unit 23 arranged to receive signals from the microprocessors 21 of the frame units 18.

An algorithm optionally within the operating programme of the microprocessor contained within the frame unit can be arranged to create a record of each anode and/or cathode current against time and analyses said record to look for the profile of a short circuit in the process of developing.

The frame unit 18 may also comprise temperature sensors 24, 25 arranged to measure the temperature of the electrode hanger bars 13, busbar arrangement 4 or the frame unit 18. Temperature sensors 24, 25 can be connected to the microprocessor 21 of the frame unit 18 and hence also communicate with the central control facility 23. The temperature sensors 24 are preferentially located close to the electrode hanger bars 13. The hanger bars 13 are the most likely source of heating of the frame unit 18. This heating could damage the Hall effect sensors 16, 17. Hence an early warning of rising temperature will enable an operator to take corrective action and avoid damage to the Hall sensors and other electronic components within the frame unit. Additionally hot hanger bars are an indication of a short circuit between electrodes. Cold hanger bars could be an indication of an open circuit. Hence the temperature sensors are another source of information about the condition of the electrolysis cell. The Hall effect sensors and the temperature sensors may therefore cooperate to provide plant operators with a warning of actual or impending problems. Optionally, the signals from the Hall effect sensors and the temperature sensors may be analysed by the microprocessor in the frame unit to provide a simple warning of a problem at that location to the control room or via a visual indicator mounts on the frame unit. The frame unit may operate even if no current sensor is in operation so that it depends entirely upon temperature detection. Some characteristics of the Hall effect sensors are temperature dependent. The temperature readings sent to the microprocessor can therefore be used to correct for temperature the signals arriving from the Hall effect sensors. Thermistors, thermocouples, digital sensors or infrared sensors may all be used as temperature sensors.

Further, the frame unit 18 may comprise an electric energy storage device 26 which may be chargeable by energy harvesting from the ambient or externally via normal power supply. A typical Hall effect sensor will draw approximately 10 mA in operation. If a frame unit should encompass four cathodes and four anodes, each surrounded by four Hall effect sensors, the total number of Hall effect sensors employed will be 32. The total current drawn by the Hall effect sensors if all are operated continuously will be 320 mA. This may be inconveniently large. Each Hall effect sensor or array of Hall effect sensors may therefore be connected to its power supply by an electronic switch (for example, a MOSFET) which is under the control of the microprocessor in the frame unit. Hence only those Hall sensors for which a reading is required at any time are activated by the microprocessor.

Since electrolysis varies with time only slowly, readings of the current (and any other measurements) need only be taken at large intervals of time. Furthermore, readings can be obtained from the Hall sensors in fractions of a second. The microprocessor can be arranged to spend most of the time in sleep mode using only a tiny amount of power with all other electronics in the frame unit turned off. Hence the average power consumption of the electronics contained within the frame unit can be very low. The frame unit can spend nearly all the time in hibernation using only a few μW of power. If there is an energy storage unit within the frame units (for example a suitably sized capacitor or rechargeable battery) this can be trickle charged from a low power source or via a 4 normal power supply. It may be possible to obtain this trickle charge by energy harvesting. There are a number of ways this can be achieved (e.g. ripple current, photovoltaic source, thermal pile or Peltier generator using the heat from the electrolysis tank). In addition this stored energy may also be used to transmit the data obtained wirelessly if desired by activating a radio transmitter for a very short time (typically a fraction of a second).

A further embodiment may also be that on the base of the frame unit, spring contacts which press against the busbar conducting elements. The purpose of these contacts is twofold: they permit power for the frame unit electronics to be collected from the busbars elements, and they enable voltage measurements to be made on the busbar elements. More contacts can be provided than is strictly necessary for operation so that there is some redundancy which is useful if contamination prevents any one spring contact from making a good connection with the busbar element. The microprocessor can monitor the state of each spring contact and advise the operator if maintenance of the frame unit is required.

Frame units 18 may also be daisy-chained electrically with power and signaling wires connected from unit to unit using plugs and sockets. Instead of using a plugs-and-socket daisy-chain system to connect frame units, it is also possible to run cable, such as a twisted pair of wires, along the side of each tank and couple power into each frame unit in a non-contact fashion while coupling data again into and out of that cabling in a non-contact fashion. It is also possible to arrange an inductive coupling between frame units. The first frame unit can be powered with hard wiring and the power can then pass wirelessly via the inductive couplings down a daisychain of the frame units.

Within the frame units 18 are stabilised power supplies which give a suitable accurate voltage output to permit the use of ratiometric Hall effect sensors within the frame unit. The microprocessor 21 within the unit can be programmed with a start-up routine which allows compensation for offset voltages from the Hall effect sensors. The microprocessor 21 can be switched on before fitting the unit 18 to the ER or EW plant to accomplish this.

During assembly, calibration of the Hall effect sensors 16, 17 may be carried out to enhance accuracy. This will require the use of a calibration apparatus capable of generating a known set of currents in a suitable dummy busbar and hanger bar structure. The microprocessor can thereby acquire and remember a calibration factor for each Hall effect sensor.

Typically a calibrating apparatus will be used to test and calibrate the Hall sensors used in the frame unit. This calibrating unit would typically have a set of hanger bars resting on bus bars in a form which emulates the structure found in the electrolysis cell. Current sources are applied to this rig which are capable of applying a pattern of currents through the various conductors during calibration in a continuous, pulsed or varying manner. In coordination with this current pattern (which is predetermined or conveyed to the microprocessor of the frame unit) measurements are taken by the microprocessor of the Hall effect sensor readings at appropriate moments in time. These readings are used to calibrate the current readings produced by the microprocessor.

A typical calibration procedure might be as follows. Assuming that all the conductors (or contact points) are surrounded by an array of four Hall effect sensors, as previously described. A first test would be to apply a current to one conductor or contact point only. Readings would be taken from the four Hall effect sensors surrounding this conductor or contact point. From these readings a measure of the current in the conductor or contact point would be obtained. Additionally and simultaneously, readings would be obtained from all other Hall effect sensors in the frame unit. This process is then repeated for all conductors or contact points which the frame unit addresses and the currents in which it is responsible for reporting. Hence, when the current in a particular conductor or contact point is being measured, the microprocessor can correct the readings in the array of Hall effect sensors surrounding that array for the effects of any currents which may be flowing in any of the other conductors or contact points. Hence the calibration and learning process which the microprocessor goes through during calibration, forms an essential role in achieving high accuracy current measurements and this methodology and associated algorithm is a further aspect of the invention.

From each frame unit 18 current information can be transmitted via the data link to a control room or monitor screen to allow the current measurements to be observed, recorded and analysed. The current data link for each tank may be terminated in a frame unit already employed for returning current information to a control room so that the already established data links may be used for transmission of data from the frame units.

In summary, the present invention provides several advantages. High accuracy of the measurement results from measuring the current in each electrode at a location where it is concentrated in a point, i.e. at the contact point. The use of a plurality of magnetic field sensors to measure each current permits good signal strength while giving good immunity to unwanted signal intrusion. The inclusion of a microprocessor in unit frames and its ability to remember location with an ID and calibration factors for each Hall effect sensor allows low cost basic Hall sensors to be employed while achieving good accuracy for the unit. The presence of a microprocessor in the unit frame enables analysis of the Hall effect sensor signals within the frame unit permitting visual signaling to operators to be located on the frame unit. Appropriate design of the frame units permit the units to be installed whilst the ER or EW plant is operating. The frame units allow operation, including raising and lowering of electrodes to proceed unhindered.

While Hall effect sensors and temperature sensors have been disclosed, the frame unit may contain also other sensors or measuring equipment in addition to those described here and its measurement facilities are not limited merely to current and temperature.

While the present inventions have been described in connection with a number of exemplary embodiments, and implementations, the present inventions are not so limited, but rather cover various modifications, and equivalent arrangements, which fall within the purview of prospective claims.

The invention claimed is:

1. A method of measuring electric current flowing in an individual electrode in an electrolysis system comprising a plurality of interleaved electrodes, cathode electrodes and anode electrodes, arranged in an electrolysis cell and immersed in electrolyte, said electrolysis system having a busbar arrangement disposed on a separating cell wall between each of the adjacent cells, said busbar arrangement comprising an equaliser busbar to electrically connect anode electrodes in one cell to cathode electrodes in a next cell providing the current with multiple electrical pathways between electrodes, said electrical connection being formed by contact points between the equaliser busbar and hanger bars of the electrodes, characterized in that the electric current in the equaliser busbar is measured at measuring points located between each pair of the adjacently neighboring contact points.

2. The method according to claim 1, characterized in that the electric current in the equaliser busbar is measured by sensing the magnetic field induced by said current flowing in the equaliser busbar.

3. The method according to claim 1, characterized in that the electric current in the equaliser busbar is measured by sensing magnetic field at the midpoint between each pair of the adjacently neighboring contact points.

4. The method according to claim 1, characterized in that the magnetic field of the electric current is sensed with a magnetic circuit being arranged to encircle the equaliser busbar.

5. The method according to claim 4, characterized in that magnetic circuit is an open loop current sensor.

6. The method according to claim 4, characterized in that the magnetic circuit is a closed loop current sensor.

7. The method according to claim 4, characterized in that the magnetic circuit comprises a core of magnetic material formed as a ring surrounding the equaliser busbar.

8. The method according to claim 1, characterized in that the electric current in the equaliser busbar is measured at the measuring point by sensing the magnetic field with one or more Hall effect sensors arranged in proximity to the equaliser busbar.

9. The method according to claim 8, characterized in that the magnetic field induced by the current flowing in the equalizer busbar is sensed with an array of Hall effect sensors arranged in the vertical plane around the equalizer busbar at the measuring point.

10. The method according to claim 1, characterized in that the electric current in each electrode is measured by sensing the magnetic field induced by said current substantially at the level of the contact points to measure the current passing through the contact point.

11. The method according to claim 10, characterized in that the magnetic field at the contact point is sensed with a magnetic field sensor arranged in the vicinity of the contact point.

12. The method according to claim 10, characterized in that the magnetic field at the contact point is sensed with an array of magnetic field sensors arranged around the contact point.

13. The method according to claim 1, characterized in that a frame unit of insulating, non-magnetic material is arranged to hold the magnetic field sensors in a predetermined position with respect to equalizer busbar at measuring points and/or to hold the magnetic field sensors in a predetermined position with respect to the contact points.

14. A current measuring arrangement for measuring electric current flowing in an individual electrode in an electrolysis system comprising a plurality of interleaved electrodes, cathode electrodes and anode electrodes, arranged in an electrolysis cell and immersed in electrolyte, said electrolysis system having a busbar arrangement disposed on a separating cell wall between each of the adjacent cells, said busbar arrangement comprising an equaliser busbar to electrically connect anode electrodes in one cell to cathode electrodes in a next cell providing the current with multiple electrical pathways between electrodes, said electrical connection being formed by contact points between the equalizer busbar and hanger bars of the electrodes, characterized in that the current measuring arrangement comprises magnetic field sensing means for measuring the magnetic field induced by the electric current in the equaliser busbar, the magnetic field sensing means being arranged at measuring points located between each pair of the adjacently neighboring contact points.

15. The arrangement according to claim 14, characterized in that the magnetic field sensing means are arranged to sense the magnetic field at the midpoint between each pair of the adjacently neighboring contact points.

16. The arrangement according to claim 14, characterized in that the magnetic field sensing means comprise a magnetic circuit being arranged to encircle the equaliser busbar.

17. The arrangement according to claim 16, characterized in that magnetic circuit is an open loop current sensor.

18. The arrangement according to claim 16, characterized in that the magnetic circuit is a closed loop current sensor.

19. The arrangement according to claim 16, characterized in that the magnetic circuit comprises a core of magnetic material formed as a ring surrounding the equaliser busbar.

20. The arrangement according to claim 14, characterized in that the magnetic field sensing means comprises one or more Hall effect sensors arranged in proximity to the equaliser busbar.

* * * * *